United States Patent [19]

LeSage

[11] 4,324,446

[45] Apr. 13, 1982

[54] JEWELRY CASE

[76] Inventor: George J. LeSage, 12 Portland St., South Lawrence, Mass. 01843

[21] Appl. No.: 160,950

[22] Filed: Jun. 19, 1980

[51] Int. Cl.[3] ..... A47F 5/08; A47B 67/02; B65D 25/10; B65D 5/52

[52] U.S. Cl. ..... 312/245; 312/246; 206/45.15; 206/45.34; 206/566

[58] Field of Search ..... 206/566, 564, 45.11, 206/45.15, 45.34; 312/245, 326, 204, 246

[56] References Cited

U.S. PATENT DOCUMENTS 2,463,338 3/1949 Wechsler ..... 206/45.11

3,930,702 1/1976 Pichowicz ..... 206/566

4,209,212 6/1980 McGoldrick ..... 206/564

*Primary Examiner*—William T. Dixson, Jr.

*Attorney, Agent, or Firm*—Edward A. Gordon

[57] ABSTRACT

A jewelry case for receiving, storing, carrying and displaying jewelry, comprising a front portion and a back portion defining at least one compartment therebetween. The front portion comprises a pair of closure members hingedly mounted to the back portion to provide easy access to the compartments. The jewelry case has means carried by the back portion and the closure members for supporting jewelry thereon, and transparent means mounted between the back portion and the closure members whereby jewelry may be retained in spaced orderly relationship.

6 Claims, 7 Drawing Figures

JEWELRY CASE

FIELD OF THE INVENTION

This invention relates to jewelry cases and more particularly to a case which is useful and efficient in the receiving, storing, carrying, organizing and displaying articles of jewelry.

BACKGROUND OF THE INVENTION

It has been a particular problem that when chains, necklaces, earrings, and other beaded necklaces with and without pendants and charms are put in a box or drawer-type jewelry cabinet or box, they become mixed up and tangled. In the case of rings, they become easily separated. In the case of very fine charms, if they become knotted or tangled, damage may result during the untangling process. While some prior jewelry cabinets have provided improvement in the hanging or supporting of jewelry articles, they still suffer the problems of tangling or knotting when the cabinet is moved or carried from one place to another. Such other prior art devices suffer from other disadvantages including lack of ready adaptability to ease of access, reception and removal, and instant visibility of the articles of jewelry.

Accordingly, it is the desire of this invention to provide a jewelry case which overcomes all of such disadvantages and which provides the unusual combinations and sub-combinations of advantages in construction, mode of operation, and in the receiving, storing, carrying, organizing, and displaying of items of jewelry.

SUMMARY OF THE INVENTION

A preferred embodiment of the jewelry case of the present invention for receiving, storing, carrying and displaying jewelry, comprises a front portion and a back portion defining compartments therebetween. The front portion comprises a pair of closure members hingedly mounted to said back portion to provide easy access to the compartments. The back portion and the closure members are provided with compartments having means for supporting jewelry thereon, and transparent means are hingedly mounted between the back portion and each closure member whereby jewelry may be retained in spaced orderly relationship and are instantly visible and easily accessible upon opening of the closure members. In the preferred embodiment, the back surface of the back portion is provided with means for attaching it to a wall or for standing it upon a dresser, table or other supporting surface in an upright position.

BRIEF DESCRIPTION OF THE DRAWINGS

For a fuller understanding of the nature and desired objects of the inventions, reference should be had to the following detailed description taken in connection with the accompanying drawing wherein like reference characters refer to corresponding parts throughout the several views and wherein.

DETAILED DESCRIPTION OF PREFERRED EMBODIMENT(S)

Figure 2:
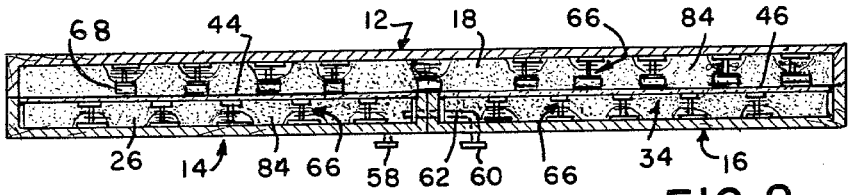
FIG. 2 is a cross-sectional view taken along the line 2—2 of FIG. 1.

Reference is now made to the several views of the drawing for the following detailed description of applicants invention relating to jewelry cases. As will be seen, applicants invention is adapted to be fixedly attached to a wall or other verticle supporting surface or to stand with its bottom on a table, dresser or other supporting surface not shown. In the drawing, the jewelry case of the present invention is illustrated as a vertically elongated case shown generally at 10. The case 10 comprises a back portion 12 and a front portion which preferably comprises closure members 14 and 16. As can be seen best in FIGS. 2 and 3, the back portion 12 contains a compartment 18 defined by top wall 20, a bottom wall 22, and side walls 24 and 24*a*. In a similar manner closure member 14 contains a compartment 26 defined by top wall 28, bottom wall 30 and side walls 32 and 32*a*. In the same manner closure 16 contains compartment 34 defined by top wall 36, bottom wall 38, and side walls 40 and 40*a*. In one preferred embodiment the compartments 18, 26, and 34 are each lined with a soft material such as velvet or felt to receive the items of jewelry. Closure members 14 and 16 are attached to the back portion by hinges 42 which may be screwed or otherwise attached to the back portion 12. While the hinges are illustrated as several hinges, it is to be understood that a single "piano" type hinge, not shown, (well known to those skilled in the art) may be used on each side instead of hinges 42*a* and 42*b*, and 42*c* and 42*d*.

In a preferred embodiment there are provided inner transparent closure members 44, 46, which are attached to closure members 14 and 16 by hinges 48*a*, 48*b*, 48*c*, and 48*d*, which are screwed or otherwise attached to the closure members. In a preferred embodiment the inner closure members are formed of a transparent plastic material. While the inner closure members 44 and 46 are illustrated as covering a portion of chambers 26 and 34, respectively, it is to be understood that the inner closure members may be lengthened to completely cover the chambers. The inner closure members 44 and 46 are preferably provided with means for releasably securing them in closed positions. Suitable means for securing the inner closure members are latch means 50*a* and 50*b* comprising rotating knobs or handles 52*a* and 52*b* and associated levers 54*a* and 54*b*. Levers 54*a* and 54*b* are releasably received by slits 56*a* and 56*b* (shown by dashed lines) for releasably holding inner closure members 14 and 16 in closed position. The closure members 14 and 16 (FIG. 1) are provided with suitable opening means such as knobs 58 and 60, and slidable bolt means 62 associated with knob 60 for securing members 14 and 16 in closed position. A key operated lock 64 is provided for locking the case 10 for privacy and protection. In one embodiment of the invention the hinges of the inner closure members are constructed to permit easy removal of the inner closure members.

Figure 3:
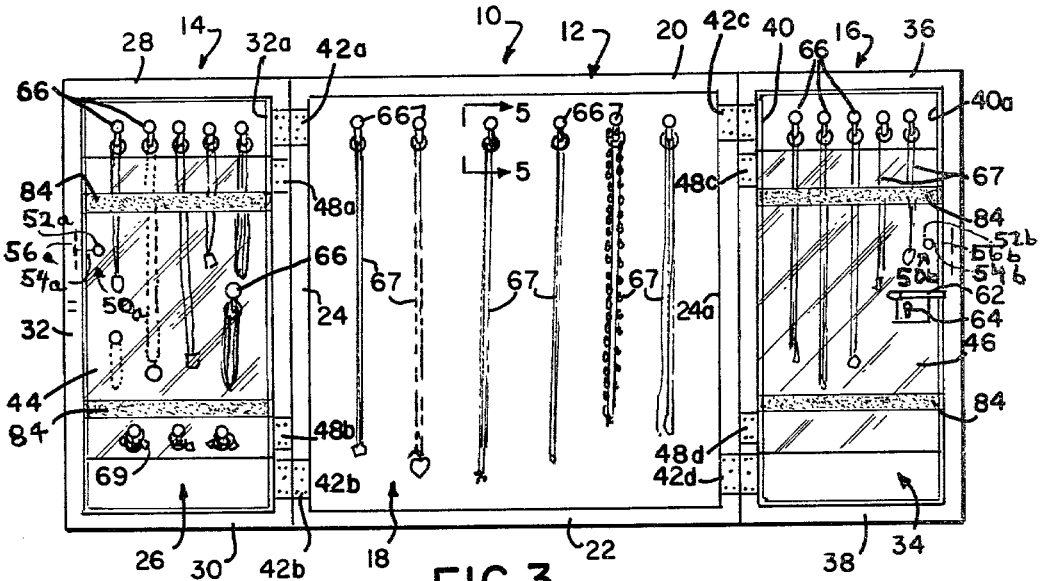
FIG. 3 is a front plan view of the jewelry case of FIG. 1 in fully open position.
Figure 5:
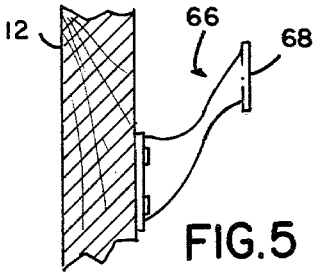
FIG. 5 is an enlarged plan view along the line 5—5 of FIG. 3 and illustrates one of the pins used to hang the jewelry.
Figure 6:
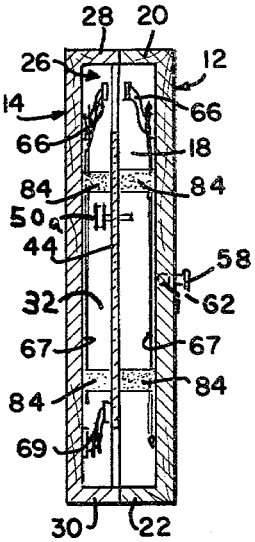
FIG. 6 is a cross-sectional view taken along the line 6—6 of FIG. 1.

FIG. 3 shows a front view of the jewelry case 10 showing the closure members 14 and 16 in open position and the interior of the compartments 18, 26 and 34 in detail. Disposed within each compartment are a plurality of means 66 for supporting jewelry thereon. The means 66 (FIG. 5) are preferably pins which are disposed upwardly at an angle to the supporting surface 12 and are provided with a contoured outer surface portion 68. The outer surface portion 68 is preferably flat so that it may be in register with the adjacent flat surfaces of inner closure members 44 and 46 when in a closed position and when adjacent such members as best seen in FIG. 6. As can be seen pins 66 serve as supports for hanging a number of long chains, necklaces, beads or other similar articles of jewelry 67 in vertically spaced positions each separate from each other. Additionally, the pins also serve as supports for rings and earrings 69 as illustrated in the lower portion of closure member 14. The inner closure members when in the closed position, serve to prevent the articles of jewelry from leaving the pins as provided by the abutting relationship between the ends of the pins and the inner surface of the inner closure members 44 and 46. The same effect is provided for the pins 66 of the back portion 12 when the closure members 14 and 16 are in closed position.

In a preferred embodiment, portions of each side of the inner closure members 44 and 46 are provided with a resilient material which serves to hold the articles of jewelry in spaced position separate from each other. The material is preferably strips 84 formed of a soft elastic material such as a plastic in porous sponge-like form. Another suitable material is felt. The main requirements of the material 84 are that it should not be abrasive to the articles of jewelry and that it be sufficiently flexible or elastic so as to at least partially conform to the contour or shape of the article of jewelry when pressed in contact thereby to hold it in a fixed position. This feature of the invention can best be seen by reference to FIGS. 2, 3, and 6. As illustrated, the strips 84 are positioned in spaced relationship on each side of the inner closure members 44 and 46. As can be seen in FIG. 3 when the inner closure members are in closed position the strips 84 adjacent the articles of jewelry 67 serve to hold them in spaced relationship from each other. Similarly, when the closure members 14 and 16 are closed as best seen in FIGS. 2 and 6 the strips 84 on the other side of the inner closure members are pressed against the articles of jewelry 66, supported on the back portion 12 of the case 10 and thereby hold them in spaced relationship to each other.

Figure 4:
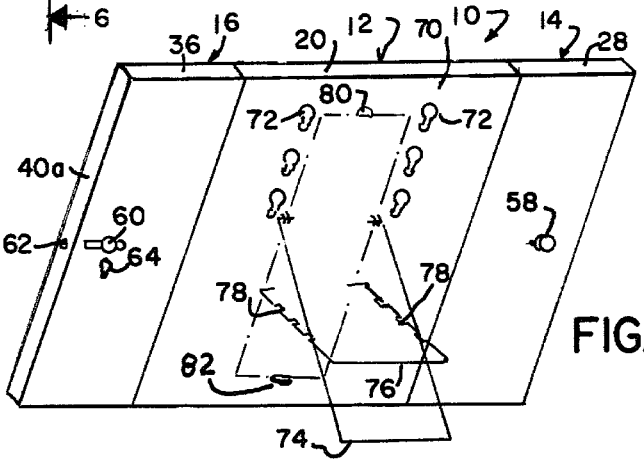
FIG. 4 is a back plan view of the jewelry case of FIG. 3 showing the means for attaching to or standing the case upon a supporting surface.

FIG. 4 illustrates a back view of the jewelry case 10 in standing position on a supporting surface such as a table, dresser or other surface not shown. The back surface 70 of case 10 is provided with a plurality of spaced holes 72 for mounting the case 10 to a wall or other vertical support. As illustrated, the case 10 is also provided with a support means 74 and a brace means 76. The brace means 76 is provided with a plurality of notches 78 for removably receiving support means 74 and providing for various angular settings with respect to the supporting surface. The dashed lines show the storing positions of the brace means and support means when not in use. Latch means 80 and 82 are provided to releasably hold respectively the support means 74 and brace means 76 in position during storage.

Figure 7:
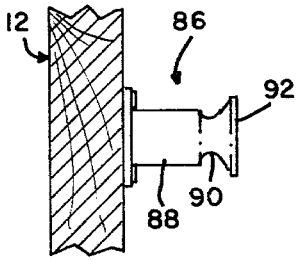
FIG. 7 is an enlarged view of another embodiment of a pin of the present invention used to support the articles of jewelry.

The casing 10 is preferably constructed of plastic materials although other suitable materials or combinations thereof may be used such as wood, pressed wood, pressed organic material, metal or other material which will minimize manufacturing costs and yet maximize the asthetic effect. Referring now to FIG. 7, there is illustrated an alternative embodiment of the pin for supporting articles of jewelry in accordance with the present invention. As shown, the pin 86 is attached, for example, to supporting back portion 12 and comprises a base portion 88, a groove 90 for receiving the articles of jewelry, and a forward flat portion 92. The pin has the general configuration of a knob.

Figure 1:
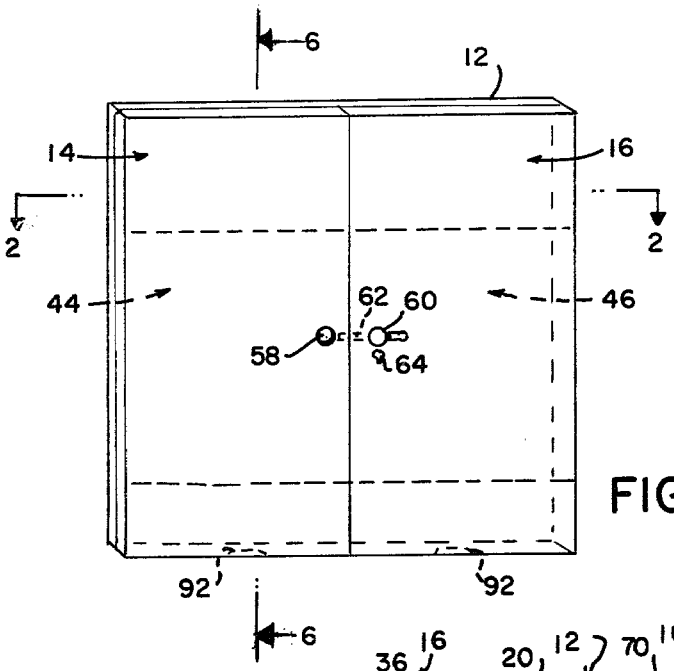
FIG. 1 is a front plan view of the jewelry case according to an embodiment of the present invention in closed position and illustrates by dashed lines the position of the inner divided closure members illustrated in FIG. 3.

In another embodiment of the present invention, the means for opening the closure members 14 and 16 may comprise grooves formed in the bottom walls 30 and 38 and illustrated by the dashed lines 92 of FIG. 1. In this embodiment, the knobs 58 and 60 and bolt 62 may be omitted.

In another embodiment the back portion 12 can be provided with inner divided transparent closure members (not shown) similar to transparent members 44 and 46. Such inner divided transparent members can be hingedly attached to side walls 24 and **24*a* in the same manner as described with respect to transparent members 44 and 46**.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrated and not in limiting sense.

What is claimed is:

1. A jewelry case for receiving, storing, carrying and displaying jewelry in spaced hanging relationship comprising:

a back member having a plurality of walls extending outwardly therefrom, and defining a first compartment therebetween, a front member hingedly mounted to said back member and having a plurality of walls extending outwardly therefrom and defining a second compartment therebetween similar to said first compartment, a plurality of pins mounted in each said compartments and extending outwardly therefrom to receive jewelry in spaced hanging relationship, a first transparent member adjacent said first compartment and having hinge means attaching said transparent member to allow said transparent member to swing from closed to open relationship with said compartment, a second transparent member adjacent said second compartment and having hinge means attaching said second transparent member to allow said second transparent member to swing from closed to open relationship with said second compartment, and resilient means disposed in spaced relationship upon said first and second transparent means and adjacent said first and second compartments respectively to contact said jewelry in each said compartments when said transparent members are in closed relationship with said respective compartments whereby said jewelry is retained in spaced hanging relationship free from mixed-up and tangled relationship.

2. A jewelry case for receiving, storing, carrying and displaying jewelry in spaced hanging relationship comprising:

a back member having a plurality of walls extending outwardly therefrom and defining a back compartment therebetween, a front member divided into two portions each having a plurality of walls extending outwardly therefrom and defining front compartments therebetween, hinge means attaching said front compartments to said back compartment to allow said front compartments to swing from open to a closed mating relationship with said back compartment, a plurality of pins mounted in each said back and front compartments and extending outwardly therefrom to receive jewelry in spaced hanging relationship, a transparent member adjacent each of said front compartments and having hinge means attaching each said transparent member to allow each transparent member to swing from closed to open relationship with the respective front compartments, resilient means disposed in spaced relationship upon the sides of said transparent members adjacent said front compartments to contact said jewelry in said front compartments when said transparent members are in closed relationship with said respective front compartments whereby jewelry in said front compartments is retained in spaced hanging relationship free from mixed-up and tangled relationship, and other resilient means disposed in spaced relationship upon the other side of each said transparent members to contact jewelry in said back compartment when said front compartments are in closed relationship with said back compartment whereby said jewelry in said back compartment is retained in spaced hanging relationship free from mixed-up and tangled relationship.

3. The jewelry case according to claims 1 or 2 wherein said resilient means are strips.

4. The jewelry case according to claims 1 or 2 wherein said transparent members are removable.

5. The jewelry case according to claims 1 or 2 including means for mounting said case upon a supporting surface.

6. The jewelry case according to claims 1 or 2 wherein said pins have a flat forward portion for contact with said transparent members when in closed relationship.

* * * * *